US007367554B2

(12) United States Patent
Mine et al.

(10) Patent No.: US 7,367,554 B2
(45) Date of Patent: May 6, 2008

(54) MEMBER FOR PREVENTING FEEDING OF A PLURALITY OF SHEETS AT A TIME

(75) Inventors: Akihiro Mine, Hyogo (JP); Hirokazu Nishimori, Hyogo (JP); Toshiyuki Hirai, Hyogo (JP)

(73) Assignee: Sumitomo Rubber Industries, Ltd., Kobe-shi (JP)

( * ) Notice: Subject to any disclaimer, the term of this patent is extended or adjusted under 35 U.S.C. 154(b) by 462 days.

(21) Appl. No.: 11/088,209

(22) Filed: Mar. 24, 2005

(65) Prior Publication Data

US 2005/0230904 A1 Oct. 20, 2005

(30) Foreign Application Priority Data

Mar. 26, 2004 (JP) ..... 2004-093388

(51) Int. Cl.
*B65H 3/52* (2006.01)

(52) U.S. Cl. ..... 271/109; 271/104; 271/137; 271/167; 271/121

(58) Field of Classification Search ..... 271/121, 271/167, 104, 137; 492/53, 56
See application file for complete search history.

(56) References Cited

U.S. PATENT DOCUMENTS 5,314,948 A * 5/1994 Pratt et al. ..... 525/64
6,179,008 B1 * 1/2001 Kawazura et al. ..... 138/125
6,273,415 B1 * 8/2001 Tengo et al. ..... 271/109
6,319,181 B1 * 11/2001 Naoi et al. ..... 492/56
6,481,707 B2 * 11/2002 Matsuo et al. ..... 271/109
6,793,611 B2 * 9/2004 Hattori et al. ..... 492/56
7,021,756 B2 * 4/2006 Nakashima et al. ..... 347/104
2002/0165075 A1 * 11/2002 Shea et al. ..... 492/56

FOREIGN PATENT DOCUMENTS

JP 8-283552 A 10/1996
JP 9-137045 A 5/1997
JP 2002-19986 A 1/2002
JP 2003-321580 A 11/2003
JP 2005314522 A * 11/2005

* cited by examiner

*Primary Examiner*—Joe H. Cheng
*Assistant Examiner*—Patrick D Cicchino
(74) *Attorney, Agent, or Firm*—Brich, Stewart, Kolasch & Birch, LLP

(57) ABSTRACT

A member for preventing feeding of a plurality of sheets at a time including a composition containing a resin component. Not less than 10 parts by mass nor more than 100 parts by mass of a polyester thermoplastic elastomer is contained in 100 parts by mass of the resin component. The polyester thermoplastic elastomer is composed of a hard segment and a soft segment. The hard segment consists of diester groups of aromatic dicarboxylic acid. The soft segment consists of ester groups of aliphatic carboxylic acid or aliphatic polyether groups.

11 Claims, 1 Drawing Sheet

MEMBER FOR PREVENTING FEEDING OF A PLURALITY OF SHEETS AT A TIME

This nonprovisional application claims priority under 35 U.S.C. § 119(a) on Patent Application No(s). 2004-093388 filed in Japan on Mar. 26, 2004, the entire contents of which are hereby incorporated by reference.

FIELD OF THE INVENTION

The present invention relates to a member for preventing feeding of a plurality of sheets at a time and more particularly to a member preventing feeding of a plurality of sheets at a time and generation of an abnormal sound and having an improved wear resistance in a favorable balance.

DESCRIPTION OF THE RELATED ART

Paper-feeding mechanisms such as various types of printers, an electrostatic copying machine, a facsimile apparatus, an automatic teller machine (ATM) and the like are provided with a paper-feeding roller and a separation sheet or a member for preventing feeding of a plurality of sheets at a time called a separation pad. The paper-feeding mechanism feeds out one sheet at a time from a tray by separating it from other sheets owing to the rotation of the paper-feeding roller. When there are several sheets left in the tray, it occurs that a plurality of sheets is fed out from the tray at a time. The reason a plurality of sheets is fed at a time is because the coefficient of friction between the tray and the sheets is lower than that between the sheets. To prevent a plurality of sheets from being fed at a time, it is necessary to increase the coefficient of friction between the tray and the sheets to a certain extent. However, if the coefficient of friction between the tray and the sheets is too high, it is difficult to feed the last sheet in the tray.

Thus it is necessary to provide the paper-feeding mechanism with a member for preventing feeding of a plurality of sheets at a time having a proper degree of coefficient of friction. The member for preventing the feeding of a plurality of sheets at a time is conventionally manufactured from a composition containing ethylene-propylene-diene (EPDM) rubber, natural rubber, polyurethane, chloroprene rubber or NBR. Improvement of the member for preventing the feeding of a plurality of sheets at a time is investigated by manufacturers to improve the coefficient of friction and wear resistance and in addition prevent the generation of an abnormal sound during the supply of paper.

In the member for preventing feeding of a plurality of sheets at a time disclosed in the patent document 1, the composition containing the EPDM rubber is crosslinked with a peroxide and methacrylate ester of higher ester to allow the member for preventing feeding of a plurality of sheets at a time to have an excellent wear resistance and suppress the generation of an abnormal sound.

A member for preventing feeding of a plurality of sheets at a time using a thermoplastic elastomer is investigated.

Conventionally, olefin copolymer and thermoplastic resin are kneaded to form the thermoplastic elastomer. Many conventional members for preventing feeding of a plurality of sheets use the thermoplastic elastomer containing the EPDM rubber and polypropylene. However, the member for preventing feeding of a plurality of sheets at a time containing polypropylene has a low wear resistance and coefficient of friction.

In the member for preventing feeding of a plurality of sheets at a time disclosed in the patent document 2, the composition containing thermoplastic resin or the thermoplastic elastomer and acrylate ester is dynamically crosslinked with a resinous crosslinking agent and a peroxide to allow the member for preventing feeding of a plurality of sheets at a time to have excellent coefficient of friction and wear resistance.

In the disclosure made in the patent document 3, it is possible to obtain a thermoplastic elastomer composition excellent in its heat resistance, oil resistance, shock resistance, injection moldability, deformation recoverableness at high temperatures, and resistance to hydrolysis by using rubber and polyester copolymer. In the disclosure, there is no limitation in the use of the thermoplastic elastomer composition.

In the disclosure made in the patent document 4, in the field of a sliding member containing a silicon elastomer, it is possible to improve the wear resistance of the sliding member when the sliding member contains a polyester thermoplastic elastomer.

Patent document 1: Japanese Patent Application Laid-Open No.2002-19986

Patent document 2: Japanese Patent Application Laid-Open No.2003-321580

Patent document 3: Japanese Patent Application Laid-Open No.9-137045

Patent document 4: Japanese Patent Application Laid-Open No.8-283552

As described above, various investigations have been made to improve the coefficient of friction and wear resistance of the member for preventing the member for feeding of a plurality of sheets at a time and prevent the generation of an abnormal sound. When the coefficient of friction is improved, it is possible to improve the effect of preventing the feeding of a plurality of sheets at a time but an abnormal sound is liable to be generated. Thus even though it is possible to prevent the feeding of a plurality of sheets at a time and improve the wear resistance to a high extent, it is difficult to prevent the feeding of a plurality of sheets at a time and the generation of an abnormal sound and improve its wear resistance in a favorable balance. The member for preventing the feeding of a plurality of sheets at a time is also demanded to have a high coefficient of friction at even a low temperature and in addition excellent heat resistance and oil resistance.

SUMMARY OF THE INVENTION

The present invention has been made to comply with the above-described demands. Therefore it is an object of the present invention to provide a member for preventing the feeding of a plurality of sheets at a time which is capable of satisfying three demands that the member prevents the feeding of a plurality of sheets at a time and the generation of an abnormal sound and has an improved wear resistance in a favorable balance.

To solve the above-described problems, the present invention provides a member for preventing feeding of a plurality of sheets at a time includes a composition containing a resin component. Not less than 10 parts by mass nor more than 100 parts by mass of a polyester thermoplastic elastomer is contained in 100 parts by mass of the resin component.

It is easy to adjust the hardness of the member for preventing feeding of a plurality of sheets at a time by adjusting the mixing amount of the polyester thermoplastic elastomer. Thereby the member for preventing feeding of a plurality of sheets at a time is capable of having a required coefficient of restitution. The polyester thermoplastic elastomer has an appropriately high degree of coefficient of restitution and a low loss factor (tan δ). Thus the polyester thermoplastic elastomer allows the member for preventing feeding of a plurality of sheets at a time to have a function of preventing the generation of an abnormal sound and have a hardness suitable for paper supply. That is, when the member for preventing feeding of a plurality of sheets at a time has a hardness too high, it has a favorable wear resistance but has a low coefficient of friction. Consequently plurality of sheets is liable to be fed at a time. However, because the member for preventing feeding of a plurality of sheets at a time has a hardness set appropriately high, it is possible to prevent the generation of an abnormal sound and the feeding of a plurality of sheets at a time. The member for preventing the feeding of a plurality of sheets at a time has also a high tensile strength and a high elongation. Thus the member for preventing feeding of a plurality of sheets at a time has an improved wear resistance. That is, the member for preventing feeding of a plurality of sheets at a time is capable of complying with the three demands that the member prevents the feeding of a plurality of sheets at a time and the generation of an abnormal sound and has an improved wear resistance in a favorable balance.

The polyester thermoplastic elastomer is excellent in its low-temperature property, oil resistance, and heat resistance. Therefore the member for preventing feeding of a plurality of sheets at a time containing the polyester thermoplastic elastomer has a high coefficient of friction at even a low temperature, is capable of securely preventing the feeding of a plurality of sheets at a time, and has a superior durability.

Supposing that the entire part by mass of the member for preventing feeding of a plurality of sheets at a time formed from the resin composition is 100, it is necessary for the member for preventing feeding of a plurality of sheets at a time to contain not less than 10 parts by mass of the polyester thermoplastic elastomer. When the content of the polyester thermoplastic elastomer in the resin component is less than 10 parts by mass, the member for preventing feeding of a plurality of sheets at a time is incapable of securely preventing the feeding of a plurality of sheets at a time and the generation of an abnormal sound and having an improved wear resistance in a favorable balance. When the content of the polyester thermoplastic elastomer in the resin component is small, the member for preventing feeding of a plurality of sheets at a time has difficulty in preventing the generation of an abnormal sound and has a possibility that it is incapable of obtaining a sufficient low-temperature property. In order for the member for preventing feeding of a plurality of sheets at a time to accomplish the prevention of the feeding of a plurality of sheets at a time, the prevention of the generation of an abnormal sound, and the improvement of its wear resistance in a favorable balance, the content of the polyester thermoplastic elastomer in the resin component is set to favorably not less than 20 parts by mass, more favorably not less than 40 parts by mass, and most favorably not less than 60 parts by mass. The resin composition may consist of the polyester thermoplastic elastomer.

It is preferable that the polyester thermoplastic elastomer includes a hard segment and a soft segment; the hard segment consists of diester groups of aromatic dicarboxylic acid; and the soft segment consists of ester groups of aliphatic carboxylic acid or aliphatic polyether groups.

It is preferable that the resin component contains an olefin rubber or a diene rubber. EPDM (ethylene-propylene-diene rubber) is preferable as the rubber. It is preferable that the ratio between a mixing amount A of the polyester thermoplastic elastomer and a mixing amount B of the EPDM is set to a range of 6:4 to 4:6.

The addition of the EPDM to the resin component allows the coefficient of friction of the member for preventing feeding of a plurality of sheets at a time to be easily adjusted and the weatherability thereof to be enhanced.

It is preferable that the resin component contains a styrene elastomer containing hydrogenated styrene groups. The styrene elastomer is composed of an end block consisting of polystyrene groups and an intermediate block composing the soft segment. Since the styrene elastomer containing the hydrogenated styrene groups does not have double bonds, the styrene elastomer is not crosslinked when dynamic crosslinking is performed. Thus the elasticity of the member for preventing feeding of a plurality of sheets at a time can be controlled easily by the dynamic crosslinking.

It is preferable that the ratio between a mixing amount A of the polyester thermoplastic elastomer and a mixing amount C of the styrene elastomer is set to a range of 4:1 to 1:1.

It is preferable that the resin component is dynamically crosslinked with peroxides.

A JIS-A hardness of the member for preventing feeding of a plurality of sheets at a time obtained by dynamically crosslinking the resin composition is not less than 65 nor more than 90. If the JIS-A hardness of the member for preventing feeding of a plurality of sheets at a time is less than 65, it has a low wear resistance. If the hardness of the member for preventing feeding of a plurality of sheets at a time is more than 90, it has a very low coefficient of friction.

The coefficient of friction of the member for preventing feeding of a plurality of sheets at a time is not less than 0.7 nor more than 1.2 when the coefficient of friction thereof is measured by a friction coefficient-measuring apparatus (HEIDON-14).

As apparent from the foregoing description, according to the present invention, it is possible to increase the coefficient of friction of the member for preventing feeding of a plurality of sheets at a time, suppress the generation of an abnormal sound much more than the conventional member for preventing feeding of a plurality of sheets at a time, and improve its wear resistance. That is, the member for preventing feeding of a plurality of sheets at a time of the present invention is capable of preventing a plurality of sheets from being fed at a time and abnormal sound from being generated and has an improved wear resistance in a favorable balance. Further the member for preventing feeding of a plurality of sheets at a time of the present invention is excellent in its low-temperature property, heat resistance, and oil resistance.

DETAILED DESCRIPTION OF THE PREFERRED EMBODIMENTS

Figure 1:
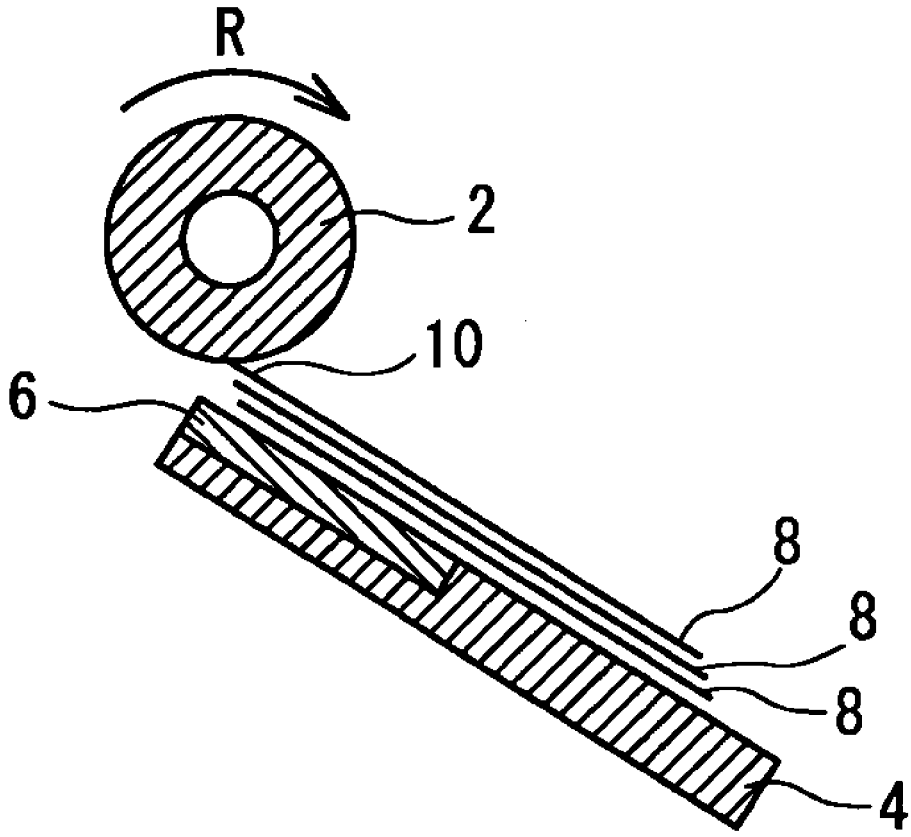
FIG. 1 is a sectional illustration showing an example of a paper-feeding mechanism including a member for preventing feeding of a plurality of sheets at a time of an embodiment of the present invention.

The embodiments of the present invention will be described below with reference to drawings.

FIG. 1 is a sectional illustration showing an example of a paper-feeding mechanism including a member of the present invention for preventing feeding of a plurality of sheets of the embodiment.

The paper-feeding mechanism has a paper-feeding roller 2, a tray 4, and a separation sheet 6 serving as the member of the embodiment for preventing feeding of a plurality of sheets. The paper-feeding roller 2 is disposed in the vicinity of one end of the tray 4, with the paper-feeding roller 2 located above the tray 4. The separation sheet 6 is disposed in the vicinity of the paper-feeding roller 2 located above the tray 4. A spring (not shown in FIG. 1) is disposed below the tray 4 located below the separation sheet 6. The upper surface of the tray 4 and that of the separation sheet are flush with each other. A plurality of sheets 8 is placed on the upper surface of the tray 4 and that of the separation sheet with the sheets layered one upon another.

One end 10 of the sheet 8 is sandwiched between the separation sheet 6 and the paper-feeding roller 2. The spring disposed below the tray 4 always presses one end of the tray 4 upward. Therefore the one end 10 of the uppermost sheet 8 contacts the paper-feeding roller 2. The sheet 8 is fed out of the tray 4 one by one owing to a rotation of the paper-feeding roller 2 in the direction shown by the arrow of FIG. 1.

The member for preventing feeding of a plurality of sheets at a time of the present invention is composed of a composition containing a resin component. The resin component contains 10 parts by mass of a polyester thermoplastic elastomer. The polyester thermoplastic elastomer includes a hard segment and a soft segment.

The hard segment consists of diester groups of aromatic dicarboxylic acid.

As the aromatic dicarboxylic acid composing the hard segment, it is possible to use phthalic acids such as terephthalic acid and isophthalic acid and 2,6-naphthalenedicarbonic acid. Of these aromatic dicarboxylic acids, the terephthalic acid is preferable. As alcohols which react with the aromatic dicarboxylic acids to form esters, aliphatic diol shown by a general formula of $HO(CH_2)_nOH$ (n is an integer from 2 to 12 and preferably 2 to 6) and alicyclic diols such as 1,1-cyclohexanedimethanol, 1,4-cyclohexanedimethanol are preferable. As an example of the hard segment, it is possible to use polybutylene terephthalate group shown by $\{CO—C_6H_4—COO(CH_2)_4—O—\}$.

The soft segment consists of ester groups of aliphatic carboxylic acid and aliphatic polyether groups. As the aliphatic carboxylic acid composing the soft segment, it is possible to use straight-chain aliphatic hydroxy-carboxylic acid having carboxylic groups and hydroxyl groups at its both ends. The aliphatic polyether composing the soft segment, it is preferable to use polyalkylene glycol ether. The weight-average molecular weight of the polyalkylene glycol ether is in the range of 400 to 6000. The soft segment containing the aliphatic polyether groups may contain ester groups. As the carboxylic acid that reacts with the aliphatic polyether to form an ester, phthalic acid is preferable. An example of the soft segment is shown by $\{CO—C_6H_4—COO—\{(CH_2)_4O\}_5—](CO—CH_2CH_2CH_2CH_2CH_2O)_m$.

In the polyester thermoplastic elastomer, the hard segment and the soft segment compose a block copolymer. The mol ratio between the hard segment and the soft segment in the block copolymer is in the range of 15 to 90% and 85 to 10%.

It is preferable that the JIS-A hardness of the polyester thermoplastic elastomer is in the range of 75 to 85.

The polyester thermoplastic elastomer has a low loss factor (tan δ). Therefore the polyester thermoplastic elastomer has a high coefficient of restitution. When the loss factor (tan δ) of the polyester thermoplastic elastomer is low, the separation pad is less subjected to sticking to and slip on paper.

It is easy to adjust the hardness of the polyester thermoplastic elastomer by adjusting the mixing ratio between the hard segment and the soft segment. Thus the hardness of the member for preventing feeding of a plurality of sheets at a time can be set to a proper hardness in consideration of the coefficient of friction thereof and the wear resistance thereof.

The polyester thermoplastic elastomer is excellent in its low-temperature property, oil resistance, and heat resistance. Therefore the member for preventing feeding of a plurality of sheets at a time containing the polyester thermoplastic elastomer has a high coefficient of friction at even a low temperature, is capable of securely preventing the feeding of a plurality of sheets at a time, and has a superior durability.

It is preferable that the resin composition contains a rubber component consisting of EPDM and is dynamically crosslinked. The dynamic crosslinking allows the rubber component and the polyester thermoplastic elastomer to be effectively alloyed with each other. That is, it is possible to disperse the rubber component as islands in the matrix consisting of the polyester thermoplastic elastomer. Such a resin composition has the advantage of the polyester thermoplastic elastomer and the excellent properties of rubber. Therefore it is possible to improve the wear resistance of the member for preventing feeding of a plurality of sheets at a time to a higher extent and enhance the effect of preventing the member for preventing feeding of a plurality of sheets at a time from generating an abnormal sound.

The kind of the rubber component is not limited to a specific one. But it is preferable to use the above-described ethylene-propylene-diene copolymer (EPDM). In addition, it is possible to use butyl rubber (IIR), butadiene rubber (BR), isoprene rubber (IR), styrene butadiene rubber (SBR), chloroprene rubber (CR), natural rubber (NR), 1,2-polybutadiene, acrylonitrile-butadiene rubber (NBR), ethylene propylene rubber, acrylic rubber (ACM), chlorosulfonated polyethylene, polytranspentenamer (PTPR), ethylene-vinyl acetate copolymer (EVA), and chlorinated polyethylene (CPE). These rubbers can be used singly or in combination. Of these rubbers, the olefin rubber and the diene rubber can be preferably used. In the present invention, it is possible to use both an oil-unextended rubber consisting of a rubber component and an oil-extended rubber containing the rubber component and an extended oil.

It is particularly preferable to use the ethylene-propylene-diene rubber (EPDM) to enhance the weatherability and oxidation resistance of the member for preventing feeding of a plurality of sheets at a time. Since the main chain of the ethylene-propylene-diene rubber consists of saturated hydrocarbon and thus includes no double bonds, the member for preventing feeding of a plurality of sheets at a time is less subject to deterioration. The member for preventing feeding of a plurality of sheets at a time containing the ethylene-propylene-diene rubber is less subject to deterioration, even though it is exposed to an ozone atmosphere having a high concentration and to irradiation of light beams for a long time. When the ethylene-propylene-diene rubber and other rubbers are used in combination, the ethylene-propylene-diene rubber is used favorably at not less than 50 parts by mass of and more favorably at not less than 80 parts by mass thereof to enhance the weatherability and oxidation resistance of the member for preventing feeding of a plurality of sheets at a time.

It is preferable to dynamically crosslink the thermoplastic elastomer with peroxides.

As the peroxides, the following organic peroxides are preferable: dicumyl peroxide (DCP), 1,3-bis (t-butyl peroxyisopropyl) benzene, 1,4-bis (t-butyl peroxyisopropyl)

3,3,5-trimethylcyclohexane, 2,5-dimethyl-2,5-di-(t-butyl peroxy) hexyne, n-butyl-4,4-bis (t-butyl peroxy) valerate, and 2,5-dimethyl-2,5-bis (t-butyl peroxy) hexane. These peroxides can be used singly or in combination. When the ethylene-propylene-diene rubber is used, the dicumyl peroxide can be preferably used because it has a high crosslinking efficiency.

When a resin crosslinking agent is used, there is a possibility that it decomposes the polyester thermoplastic elastomer. Thus in the present invention, the peroxides are used as the dynamic crosslinking agent.

Softening agents such as oil, a plasticizer, and the like may be added to the composition composing the member for preventing feeding of a plurality of sheets at a time. The addition of the softening agents reduces the hardness of the member for preventing feeding of a plurality of sheets at a time and improves its coefficient of friction.

As the oil, it is possible to use mineral oils such as paraffin oil, naphthenic oil, aromatic oil, and hydrocarbon oligomer. As the plasticizer, it is possible to use dioctyl phthalate, dibutyl phthalate, dioctyl sebacate, and dioctyl adipate.

A proper amount of a filler, a reinforcing agent, an antioxidant, wax, a coloring agent, and a crosslinking assistant agent may be added as necessary to the composition composing the member for preventing feeding of a plurality of sheets at a time.

As the filler that can be contained in the composition, it is possible to use talc, silica, carbon, titanium oxide, aluminum, whisker, calciumcarbonate, clay, glass fiber, and carbon fiber. The addition of the filler to the composition improves the mechanical strength of the member for preventing feeding of a plurality of sheets at a time. It is preferable to add not more than 30 parts by mass of the filler to 100 parts by mass of the resin component.

Carbon black or the like can be used as the reinforcing agent that can be contained in the composition. The addition of the carbon black to the composition improves the wear resistance of the member for preventing feeding of a plurality of sheets at a time. As the carbon black, it is possible to use HAF, MAF, FEF, GPF, SRF, SAF, MT, and FT. It is preferable that the diameter of the particle of the carbon black is not less than 10 μm nor more than 100 μm to disperse the carbon black favorably in the composition. It is preferable to add not more than 0.1 nor more than 30 parts by mass of the carbon black to 100 parts by mass of the resin component.

The preparation of the composition is performed by an ordinary method conventionally adopted. For example, necessary components are kneaded by using known kneader such as an open roll, a Banbury mixer, a mono-axial extruder or a biaxial extruder to obtain the composition. When the composition contains the rubber component, dynamic crosslinking progresses during a kneading operation. The dynamically crosslinked rubber is dispersed as fine particles in the matrix consisting of the polyester thermoplastic elastomer. The components are kneaded at 160° C. to 220° C. The obtained composition is molded into a sheet by known means such as extrusion molding, injection molding or compression molding.

EXAMPLE 1

By using a tumbler, the following components were dry-blended: 40 parts by mass of ethylene-propylene-diene rubber (EPDM), 60 parts by mass of polyester thermoplastic elastomer, 15 parts by mass of styrene elastomer A containing hydrogenated styrene groups, 1 part by mass of carbon black, and a 1.1 parts by mass of a crosslinking agent. Thereby a composition was obtained. Thereafter the obtained composition was supplied to a biaxial extruder ("HTM38" produced by Ipeck Inc.) to knead and dynamically crosslink it at 200° C. The composition extruded in the shape of a sheet was sliced or abraded to obtain the sheet-shaped member for preventing feeding of a plurality of sheets at a time having a thickness of 2.0 mm.

The following substances were used as the above-described components.

EPDM rubber: "Nodel IP (commercial name) produced by Du-Pont-Dow-Elastomer Inc.

Polyester thermoplastic elastomer A: A substance produced by Toyobo Inc. was used. As the hard segment thereof, a substance shown by $\{CO—C_6H_4—COO(CH_2)_4—O—\}x$ was used. As the soft segment thereof, a substance shown by $[CO—C_6H_4—COO\{(CH_2)_4C\}y]y$ was used.

Styrene elastomer A: "Septon HG252 (commercial name)" produced by Kuraray was used.

Carbon black: "Sheast SO (commercial name)" produced by Tokai carbon was used.

Crosslinking agent A: "Perhexa 25 B (commercial name)" which is an organic peroxide produced by Nippon Yushi Inc. was used.

EXAMPLES 2 THROUGH 5 AND COMPARISON EXAMPLES 1 AND 2

Except that the components of the compositions of the member for preventing feeding of a plurality of sheets at a time of each of the examples 2 through 4 and comparison examples 1 and 2 were altered as shown in table 1, they were prepared by carrying out a method similar to that used in the example 1. In table 1, the unit of the numerical values showing the mixing amounts of the components is part by mass.

As each of the components shown in table 1 overlapping the component of the example 1, the substance having the same commercial name as that of the example 1 was used. The following substances were used as the components other than those used in the example 1.

Polyester thermoplastic elastomer B: produced by Toyobo Inc. was used. As the hard segment thereof, a substance shown by $\{CO—C_6H_4—COO(CH_2)_4—O—\}x$ was used. As the soft segment thereof, a substance shown by $[CO—C_6H_4—COO\{(CH_2)_4O\}y]y$ was used.

Polyester thermoplastic elastomer C: A substance produced by Toyobo Inc. was used. As the hard segment thereof, the substance shown by $\{CO—C_6H_4—COO(CH_2)_4—O—\}x$ was used. As the soft segment thereof, a substance shown by $[CO—C_6H_4—COO\{(CH_2)_4O\}]y$ was used.

Polyester thermoplastic elastomer D: "Hitrell 3046 (commercial name)" produced by Toyobo Inc. was used. As the hard segment thereof, a substance shown by $\{CO—C_6H_4—COO(CH_2)_4—O—\}x$ was used. As the soft segment thereof, a substance shown by $[CO—C_6H_4—COO\{(CH_2)PO\}y]y$ was used.

Styrene elastomer B: "Septon 2063 (commercial name)" produced by Kuraray was used.

Polypropylene: "Novatech PPBC6 (commercial name)" produced by Nippon Polychem Inc. was used.

Crosslinking agent B: "Tackyroll 250-III (commercial name)" which is a resin crosslinking agent produced by Taoka Kagaku Kogyo Inc. was used.

Evaluation

The following measurement and evaluation were made on the member for preventing feeding of a plurality of sheets at a time of each of the examples and the comparison examples prepared as described above. Table 1 shows the results.

TABLE 1

| | E1 | E2 | E3 | E4 | E5 | CE1 | CE2 |
|---|---|---|---|---|---|---|---|
| EPDM rubber | 40 | 60 | | | | 70 | 95 |
| NBR: "N2325" (produced by Nippon Zeon) | | | | | 40 | | |
| Polypropylene | | | | | | 30 | |
| Polyester thermoplastic elastomer A | 60 | | | | 60 | | 5 |
| Polyester thermoplastic elastomer B | | 40 | | | | | |
| Polyester thermoplastic elastomer C | | | 50 | | | | |
| Polyester thermoplastic elastomer D | | | | 100 | | | |
| Styrene elastomer A | 15 | 15 | 10 | | | | |
| Styrene elastomer B | | | 40 | | | | |
| Carbon black | 1 | 1 | 1 | 1 | 1 | 1 | 1 |
| Crosslinking agent A | 1.1 | 1.6 | | | 2.3 | | 2.5 |
| Crosslinking agent B | | | | | | 5.6 | |
| Hardness | 86 | 88 | 66 | 83 | 85 | 89 | 90 |
| Initial coefficient of friction | 0.8 | 0.9 | 1.0 | 0.8 | 0.9 | 0.7 | 0.9 |
| Loss factor (Tanα) | 0.060 | 0.080 | 0.120 | 0.050 | 0.095 | 0.140 | 0.100 |
| Abrasion wear ($\times 10^{-3}$ $cm^3$) | 6.2 | 6.6 | 10.0 | 8.0 | 5.0 | 11.0 | 10.0 |
| Feeding of a plurality of sheets at a time during paper supply | ○ | ○ | ○ | ○ | ○ | Δ | ○ |
| Generation of abnormal sound | ◎ | ◎ | ○ | ○ | ○ | X | X |
| Coefficient of friction (LL condition) | 0.8 | 0.8 | 1.0 | 0.8 | 0.8 | 0.55 | 0.7 |

where E denotes example and where CE denotes comparison example.

Hardness

By using an A-type spring hardness meter specified in JIS-K6253, the JIS-A hardness of the specimen of the member for preventing feeding of a plurality of sheets at a time of each of the examples and the comparison examples was measured.

Friction of Coefficient

A friction coefficient-measuring apparatus of HEIDON-14 (TRYBO GEAR TYPE: HEIDON-14DR (commercial name) manufactured by Shinto Kagaku Inc.) was prepared. The coefficient of friction of the specimen of the member for preventing feeding of a plurality of sheets at a time of each of the examples and the comparison examples was measured at 23° C. and a relative humidity of 55% (high temperature and high relative humidity) by using paper ("Proper bond paper (commercial name) manufactured by Canon Inc.) as the measuring paper. As the measuring condition, the load was set to 200 gf, and the speed was set to 600 mm/minute. The size of each specimen was 10 mm×30 mm. The coefficient of friction of each specimen was also measured at 10° C. and a relative humidity of 15% (low temperature and low relative humidity).

Loss Factor (tan δ) The viscoelasticity of each specimen was measured by using a viscoelasticity-measuring apparatus manufactured by Leology Inc. to find the loss factor (tanδ) thereof. The measuring conditions were set as follows:

Jig: used to pull the specimens

Waveform: sine wave

Distance between chucks: 20 mm

Fundamental frequency: 10 Hz

Displacement amplitude: 50 μm

Initial control: 2 mm in strain mm and 23° C.

Configuration of specimen: 4 mm×30 mm×1 mm

Abrasion Wear

After the initial weight of each of the specimens was measured, they were mounted on a printer ("LBP1310 (commercial name) manufactured by Canon Inc.). 30000 pieces of PPC paper were supplied to the printer at 23° C. and a relative humidity of 55%. To determine the abrasion wear of each specimen, the difference between initial weight thereof and the weight thereof after paper supply finished was computed. The smaller the abrasion wear value, the more favorable the wear resistance.

Feeding of a Plurality of Paper at a Time During Paper Supply

When 30000 pieces of PPC paper were supplied to the printer to determine the abrasion wear of each specimen, whether a plurality of paper was fed at a time was checked. The specimens which prevented the feeding of a plurality of paper at a time were marked as ○. On the other hand, the specimens which failed several times in preventing the feeding of a plurality of paper at a time were marked as Δ.

Evaluation on Generation of Abnormal Sound

When 30000 pieces of PPC paper were supplied to the printer to determine the abrasion wear of each specimen, whether the specimens caused generation of an abnormal sound was checked. The specimens which did not cause generation of an abnormal sound were marked as ◎. The specimens which cause generation of an abnormal sound to a slight extent were marked as ○. The specimens which cause generation of an abnormal sound were marked as X.

Examination of Results

As shown in table 1, the member for preventing feeding of a plurality of sheets at a time of each embodiment containing the polyester thermoplastic elastomer in the amount shown in table 1 had a high coefficient of friction and yet had a low loss factor (tan δ). Therefore the member for preventing feeding of a plurality of sheets at a time of each embodiment suppressed generation of an abnormal sound. That is, these specimens had a favorable balance between the coefficient of friction thereof and the performance of preventing the generation of an abnormal sound. Further the member of each embodiment for preventing feeding of a plurality of sheets at a time did not fail in preventing the feeding of a plurality of paper at a time and was excellent in the wear resistance thereof. Furthermore the coefficient of friction of the member for preventing feeding of a plurality of sheets at a time of each embodiment did not decrease even at the low temperature and the low relative humidity.

On the other hand, the member for preventing feeding of a plurality of sheets at a time of the comparison example 2 containing a small amount of the polyester thermoplastic elastomer did not fail in preventing the feeding of paper at a time but was incapable of suppressing the generation of an abnormal sound. The member for preventing feeding of a plurality of sheets at a time of the comparison example 1 containing no polyester thermoplastic elastomer had a low value in the initial coefficient of friction and the coefficient of friction at the low temperature and the low relative humidity. In addition, the member for preventing feeding of a plurality of sheets at a time of the comparison example 1 failed in suppressing the feeding of a plurality of paper at a time and was incapable of suppressing the generation of an abnormal sound.

The member for preventing feeding of a plurality of sheets at a time of the present invention can be used for paper-feeding mechanisms such as various types of printers, an electrostatic copying machine, a facsimile apparatus, an automatic teller machine (ATM), and the like. The member of the present invention for preventing feeding of a plurality of sheets at a time is capable of preventing the feeding of a plurality of sheets at a time and the generation of an abnormal sound and has an improved wear resistance in a favorable balance. Therefore the member for preventing feeding of a plurality of sheets at a time of the present invention is very useful.

What is claimed is:

1. A sheet-separation member having a composition which comprises a resin component, and as polyester thermoplastic elastomer, wherein not less than 10 parts by mass nor more than 100 parts by mass of the polyester thermoplastic elastomer is contained in 100 parts by mass of said resin component and wherein said polyester thermoplastic elastomer comprises a hard segment and a soft segment, said hard segment consisting of diester groups of an aromatic dicarboxylic acid and said soft segment consisting of ester groups of an aliphatic carboxylic acid or aliphatic polyether groups.

2. The sheet-separation member according to claim 1, wherein said resin component contains an olefin rubber or a diene rubber.

3. The sheet-separation member according to claim 2, wherein said rubber is EPDM (ethylene-propylene-diene) rubber; and a ratio between a mixing amount A of said polyester thermoplastic elastomer and a mixing amount B of said EPDM is within a range of 6:4 to 4:6.

4. The sheet-separation member according to claim 1, wherein said resin component contains a styrene elastomer containing hydrogenated styrene groups; and a ratio between a mixing amount C of said polyester thermoplastic elastomer and a mixing amount D of said styrene elastomer is within a range of 4:1 to 1:1.

5. The sheet-separation member according to claim 1, wherein said resin component contains a dynamic crosslinking agent and is dynamically crosslinked.

6. The sheet-separation member according to claim 5, wherein said dynamic crosslinking agent is a peroxide.

7. An image-forming apparatus containing the sheet separation device of claim 1.

8. A sheet-separation member having a composition which comprises a resin component, and as polyester thermoplastic elastomer, wherein not less than 10 parts by mass nor more than 100 parts by mass of the polyester thermoplastic elastomer is contained in 100 parts by mass of said resin component and wherein a JIS-A hardness of said sheet-separation member is not less than 65 nor more than 90 and a coefficient of friction thereof is not less than 0.7 nor more than 1.2.

9. An image-forming apparatus contain the sheet separation device of claim 8.

10. A sheet-separation device which comprisings a tray having a recessed portion, a sheet-separation member disposed in said recessed portion, and a paper feeding mechanism operatively associated with said sheet-separation member, said sheet-separation member having a composition which comprises a resin component, and as polyester thermoplastic elastomer, wherein not less than 10 parts by mass nor more than 100 parts by mass of the polyester thermoplastic elastomer is contained in 100 parts by mass of said resin component and wherein said polyester thermoplastic elastomer comprises a hard segment and a soft segment, said hard segment consisting of diester groups of an aromatic dicarboxylic acid and said soft segment consisting of ester groups of an aliphatic carboxylic acid or aliphatic polyether groups.

11. A sheet-separation device which comprising a tray having a recessed portion, a sheet-separation member disposed in said recess portion, and a paper feed mechanism operatively associated with said sheet-separation member, said sheet-separation member having a composition which comprises a resin component and a polyester thermoplastic elastomer, wherein not least than 10 parts by mass and not more than 100 parts by mass of the polyester thermoplastic elastomer is contained in 100 parts by mass of said resin component and wherein a JIS-A hardness of said sheet-separation member is not less than 65 nor more than 90 and a coefficient of friction thereof is not less than 0.7 nor more than 1.2.

* * * * *